US006404078B1

(12) United States Patent
Thomas et al.

(10) Patent No.: US 6,404,078 B1
(45) Date of Patent: Jun. 11, 2002

(54) ELECTRIC SWITCH

(75) Inventors: Roger Thomas, Stockton on Tees; Daniel Bone, Langley Moor, both of (GB)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/334,091

(22) Filed: Jun. 16, 1999

(30) Foreign Application Priority Data

Jun. 16, 1998 (GB) ..... 9812931

(51) Int. Cl.[7] ..... H01H 3/02
(52) U.S. Cl. ..... 307/115; 56/16.7; 200/541
(58) Field of Search ..... 200/16 A, 16 R, 200/284, 537, 538, 540, 541, 543, 545; 56/11.9, 16.7; 307/115, 112, 119

(56) References Cited

U.S. PATENT DOCUMENTS

| | | | | | |
|---|---|---|---|---|---|
| 3,564,186 | A | | 2/1971 | Mittlestadt et al. | |
| 4,044,532 | A | * | 8/1977 | Lesig, III | 56/10.5 |
| 4,167,221 | A | * | 9/1979 | Edmonson et al. | 200/157 |
| 4,430,604 | A | * | 2/1984 | Loganbill et al. | 318/379 |
| 4,882,896 | A | * | 11/1989 | Wilcox | 56/11.9 |
| 5,203,174 | A | * | 4/1993 | Long | 56/10.1 |
| 5,442,901 | A | * | 8/1995 | Niemela et al. | 56/11.9 |
| 5,490,370 | A | * | 2/1996 | McNair et al. | 56/11.9 |
| 6,018,937 | A | * | 2/2000 | Shimada et al. | 56/10.5 |
| 6,092,355 | A | * | 7/2000 | Ishmael | 56/11.9 |
| 6,170,241 | B1 | * | 1/2001 | Shibliski et al. | 56/11.9 |

FOREIGN PATENT DOCUMENTS

| | | |
|---|---|---|
| GB | 2298116 | 8/1996 |
| WO | 9508256 | 3/1995 |
| WO | 9738468 | 10/1997 |

* cited by examiner

*Primary Examiner*—Josie Ballato
*Assistant Examiner*—Roberto Rios
(74) *Attorney, Agent, or Firm*—Harness, Dickey & Pierce, P.L.C.

(57) ABSTRACT

A battery powered lawn mower includes a cutting deck 2; an electric motor 6 mounted on the deck 2; a battery 8 mounted on the deck which is in electrical connection with the motor 6; and a switch 12 mounted on the deck 2. The switch is disposed closely adjacent both the battery 8 and the motor 6 and is between the battery and motor in the electrical circuit. The switch is linked by a cable to a lever mounted on the mower handle which controls the switch so as to be in one of two positions. In the first position the switch links the motor and battery so as operate the motor. In the second position, the switch links the two terminals of the motor so as to create regenerative braking within the motor.

30 Claims, 4 Drawing Sheets

ELECTRIC SWITCH

The present invention relates to lawn mowers and in particular to battery powered lawn mowers.

Commercially available types of battery powered lawn mowers usually comprise a cutting deck mounted on four wheels. A battery is mounted on the cutting deck together with an electric motor. The motor rotatingly drives a cutting blade which is located below the cutting deck. A handle is attached to the rear of the deck and which is used by an operator to maneuver the lawn mower. An electric switch is mounted on the handle near to the section gripped by an operator so that the operator can squeeze a lever which operates the switch. A cable runs from the battery to the switch, a second cable runs from the switch to the motor and a third cable runs from the motor to the battery to form an electric circuit. Activation of the switch completes the circuit and thus energizes the motor.

One problem with battery powered mowers is that run time between recharges of the mower is limited and dependent on the size of the battery.

As the size of the battery increases its weight and hence the weight of the overall mower increases, thus reducing the ease of handling and maneuverability of the mower. Therefore, the size of the battery is a compromise between the length of the run time between recharges and the maneuverability of the mower. Therefore, the amount of power which can be stored in the battery and which is available to drive the motor is limited.

It is desirable to maximize the running time of the mower between recharges of the battery.

One way of achieving this is by minimizing the amount of energy wasted through the electric circuit between the battery and motor when the motor is running. The amount of energy lost through electric cables is dependent on the length of the cables. Therefore, it is desirable to minimize the length of the cables of the circuit in order to reduce the amount of energy lost through the cables. This can be achieved by mounting the switch on the deck of the mower, thus avoiding the use of the cables which run from the deck along the length of the handle to the switch.

U.S. Pat. No. 3,564,186 discloses an electric mower having a switch mounted on the deck. The switch is operated by a bowden cable which connects at the other end to a lever mounted on the handle. In battery powered mowers the output voltage of the battery is low, often less than 20 V. Therefore, in order for the motor to generate sufficient power when it is running, it must draw a considerable current from the battery through the interconnecting cables. The amount of power lost through the interconnecting cables is dependent on the square of the value of current multiplied by the resistance of the interconnecting cable $I^2R$. Therefore, a small variation in the resistance of the interconnecting cable can have a large effect on the amount of energy lost through the interconnecting cables in a battery powered mower. The problem with the design of the mower disclosed in U.S. Pat. No. 3,564,186 is that the switch is connected to the motor via wires which are require to be attached to the terminals of the switch. This introduces resistive barriers into the electric circuit and thus wastes energy. The amount of energy wasted would be considerable if the design of the mower described in U.S. Pat. No. 3,564,186 was powered by a battery.

Furthermore, due to resistance in the electric circuit there would be a voltage drop between the battery and the motor, thus reducing the voltage supply to the motor and hence the amount of power the motor is able to produce. The requirement to attach wires to the switch also increases production time and costs.

It is desirable to use regenerative breaking in an electrical lawn mower when switching the motor off. Regenerative braking can be induced in the motor when it is rotating after the electrical power to the motor has been disconnected by electrically connecting the terminals of the motor together. Regenerative braking uses the energy stored within the motor to slow the rotation of the motor. This is commonly implemented in a battery powered mower by adding a third cable which runs from the motor to a switch mounted on the handle to enable the switch to connect together the terminals of the motor when it disconnects the electricity supply to the motor. This adds extra cost in providing the additional wiring.

The energy used for the regenerative braking of the motor is lost through the regenerative braking circuit. The amounts of energy can be considerable which result in large potentials and currents being generated. This results in arcing which can damage the components of the regenerative braking circuit. It is therefore desirable to dissipate the energy generated in the regenerative circuit as efficiently as possible. Therefore, in contrast to the electric circuit which is formed whilst the motor is running, it is desirable to introduce into the regenerative electric circuit a resistance through which the energy can be dissipated. Common designs of regenerative circuits and the methods by which a resistance is incorporated are complex and thus expensive.

The object of the present invention is to provide a battery powered mower which overcomes the above problems.

According to the present invention there is provided a battery powered lawn mower which comprises a cutting deck;

an electric motor mounted on the deck;

a battery mounted on the deck and which is in electrical connection with the motor;

a switch mounted on the deck and which forms part of the electrical connection between the battery and the motor, the switch comprising terminals, with the terminals which are in electrical connection with the motor and through which electrical current passes when the motor is running extend from the switch and connect directly to the terminals on the motor.

By extending the terminals of the switch from the switch directly to the terminals of the motor the terminals of the switch act as busbars, providing a solid conductor with a large cross section between the switch and the motor which is capable of transmitting large currents efficiently and with minimal loss between the switch and the motor. Furthermore, the number of interconnections, such as solder joints, connectors etc., in the electrical circuit between the switch and motor is reduced thereby reducing the amount of energy lost through the electrical connection. This is a particularly important feature in a battery powered electric mower in which a large current is drawn through the interconnecting conductors. Any reduction of the resistance of the interconnecting conductors can make a significant reduction in energy losses and thus improve the run time of the mower. Furthermore, because the resistance of the interconnecting conductor is reduced, the voltage drop across the conductors is also reduced. Therefore, the voltage across the electric motor is increased enabling the motor to provide a higher power output due to the increased voltage supply across its terminals. It also simplifies the production process by reducing the number of electrical connections which need to be manufactured and components parts which need to be used, thus saving time and money. It also produces a more robust connection between the switch and the motor. This is an important feature for a mower as the motor and switch and their interconnections are subjected to a considerable amount of vibration when the mower is used.

Preferably, the switch comprises internal connectors which extend from within the switch to form the terminals of the switch. By having one continuous piece of conductive material forming the internal connectors, the terminals of the switch and the interconnection between the switch and the terminals of the motor, the number of interconnections in the electrical circuit between the switch and the terminals of the motor are further minimized. Furthermore, the internal connector, the terminal of the switch and the interconnection between the switch and the terminal of the motor are formed as a single component.

The terminals of the switch can be attached to the terminals of the motor using a nut and bolt, clips, electrical connectors or clamps. However, it is preferable that the terminals of the switch are permanently connected to the terminals of the motor. By permanently attaching the terminals of the switch to the terminals of the motor by soldering for example, ensures that a good electrical connection is made between the two and which continues to provide a good connection over a period of time.

To remove the interconnection between the terminals of the switch and the terminal of the motor to further reduce the number of resistive barriers, the motor could preferably comprise electrical brushes wherein the terminals are integrally formed with the brushes. The brushes can be held in plastic holders. This provides a cheap and simple mechanism for supporting the brushes. To further simplify the construction, the holders can be integrally formed with the body of the motor.

Preferably the switch is located adjacent the terminals of the motor. This reduces the distance between the switch and the terminals, thus reducing the length of the conductor between the switch and the terminals of the motor, thus reducing costs and the amount of energy lost through the interconnection.

In order to reduce the energy losses through the electrical connection between the battery and the motor yet further, the terminals of the switch which are in electrical connection with the battery may be extended from the switch to connect directly to the terminals of the battery.

The terminals of the switch can be used to secure the switch in position. This provides a simple and easy way of securing the switch onto the mower. It further reduces the cost of the mower as separate mounting means for the switch are not required.

Electrically powered lawn mowers often comprise an over current protection device to provide protection to the motor and the battery. Ideally, the terminals of the over current protection device are connected directly to the terminals of the switch. This helps to minimize the number of connections required within the circuit. Over current protection devices include fuses, thermal cut out devices and safety key switches. The over current protection device can be integrally formed with the switch. Alternatively, the switch can comprise a socket for receiving the over current protection device. Often the over current protection device is located remotely from the switch, motor and battery. This requires additional wiring between the over current protection device and the other components within the electric circuit. By locating the over current protection device next to the switch, the length of the interconnecting conductors is reduced, minimizing the amount of energy lost through the interconnecting connectors.

To further simplify the construction of the switch, the socket can be integrally molded into the body of the switch, thus forming a compact design.

The over current protection device can be releasably attachable to the socket. This enables the operator to disable the lawn mower when it is not in use. The operator simply removes the over current protection device thus breaking the circuit and preventing the mower from being switched on. When the operator wishes to use the mower, he re-inserts the over current protection device to complete the electrical circuit.

The body of the switch may be integrally formed within the motor housing. This results in a simplified and robust construction further simplifying the manufacturing process of the mower.

The design of the switch can comprise a relay. However, a mechanical switch is more desirable as they are cheaper to produce and require no electrical power in order to operate. One such design of switch comprises a moving connector mounted on a sliding element which is capable of sliding over the fixed connectors and which is capable of making electric connection between differing adjacent internal connectors depending on the relative position between the sliding element and the internal connectors.

Ideally, the switch is configured to switch between two modes of operation, a first mode wherein the switch completes the electric circuit between the battery and the motor and a second mode wherein the electric circuit is broken and the two terminals of the motor are connected together to cause regenerative breaking in the motor when the motor is rotating. One such design of switch comprises a first terminal which connects to both a terminal on the motor and to a terminal on the battery, a second terminal which connects to the second terminal on the motor and a third terminal which connects to the second terminal of the battery, wherein the first mode of operation, the switch, electrically connects the second terminal to the third terminal and in the second mode of operation the switch electrically connects the first terminal of the switch to the second terminal. By constructing the switch in this manner, it produces a simple and compact structure which enables the switch to be easily changed between its two modes of operation. The third terminal connects to the second terminal of the battery via a fourth terminal which is connected to the third terminal via the current over load device.

The regenerative breaking circuit formed when the switch is in the second mode of operation may comprise a resistance. Such resistance can be created by the insertion of a resistor or a coil of resistive wire.

A second design of switch which incorporates a resistance within the regenerative breaking circuit may comprise a first terminal which connects to both a terminal on the motor and a terminal on the battery, a second terminal which connects to the first terminal via resistance, a third terminal which connects to the second terminal of the motor and a fourth terminal which connects to the second terminal of the battery wherein in the first mode of operation the switch electrically connects the third terminal to the fourth terminal and in the second mode of operation the switch electrically connects the second terminal to the third terminal of the switch. The fourth terminal may connect to the second terminal of the battery via a fifth terminal, which is connected to the fourth terminal via a current over load device to provide protection.

Ideally, the switch comprises a connector in electrical contact with at least one terminal. This provides a simple power outlet to which can be attached other electrical devices mounted on the lawn mower. The power outlet connects directly to main electric circuit of the mower and can be configured such that it is switched on only when the motor of the mower is activated. The design of the switch can be simplified by constructing the body of the connector integrally with the body of the switch.

The switch can be operated by a mechanical link such as a rod or, preferably a bowden cable.

Four specific embodiments of the invention will now be described in relation to drawings of which:

Figure 1:
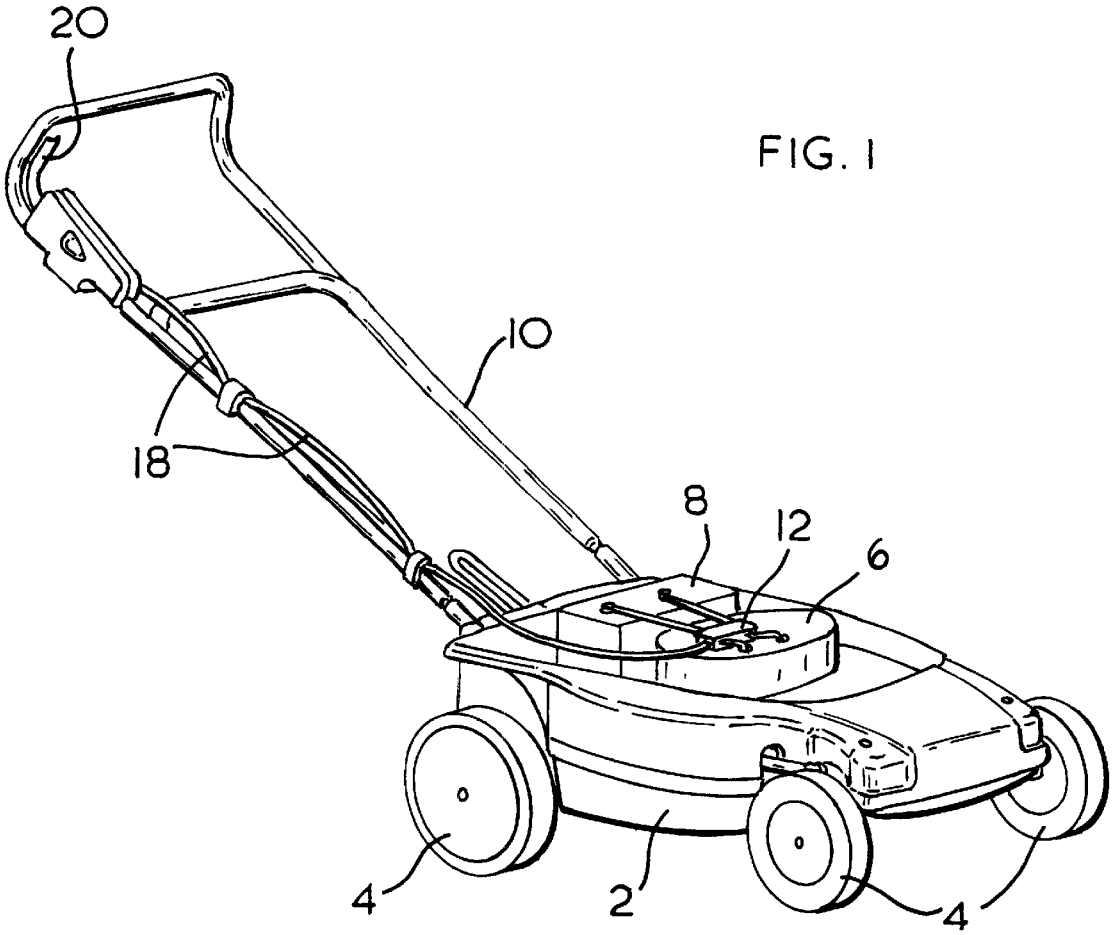
FIG. 1 shows a perspective view of a battery powered lawn mower with the hood and grassbox removed.

As can be seen in FIG. 1, the lawn mower comprises a cutting deck 2 which is mounted upon four wheels 4. An electric motor 6 and a battery 8 are mounted upon the deck. The motor 6 rotatingly drives a cutting blade not shown located below the deck 2 about a substantially vertical axis in known fashion. A handle 10 is attached to the rear of the mower which is of standard design. The battery 8 is connected to the motor 6 via a switch 12 which is mounted directly on top of the motor 6 adjacent the terminals 14,16 of the motor 8. A hood not shown covers the switch 12, battery 8 and motor 6 and a grassbox not shown is attached to the rear of the mower for the collection of the grass. The switch 12 is operated by a bowden cable 18 which is attached at one end to the switch 12 and at the other end to a releasably lockable pivotal lever 20.

Figure 2:
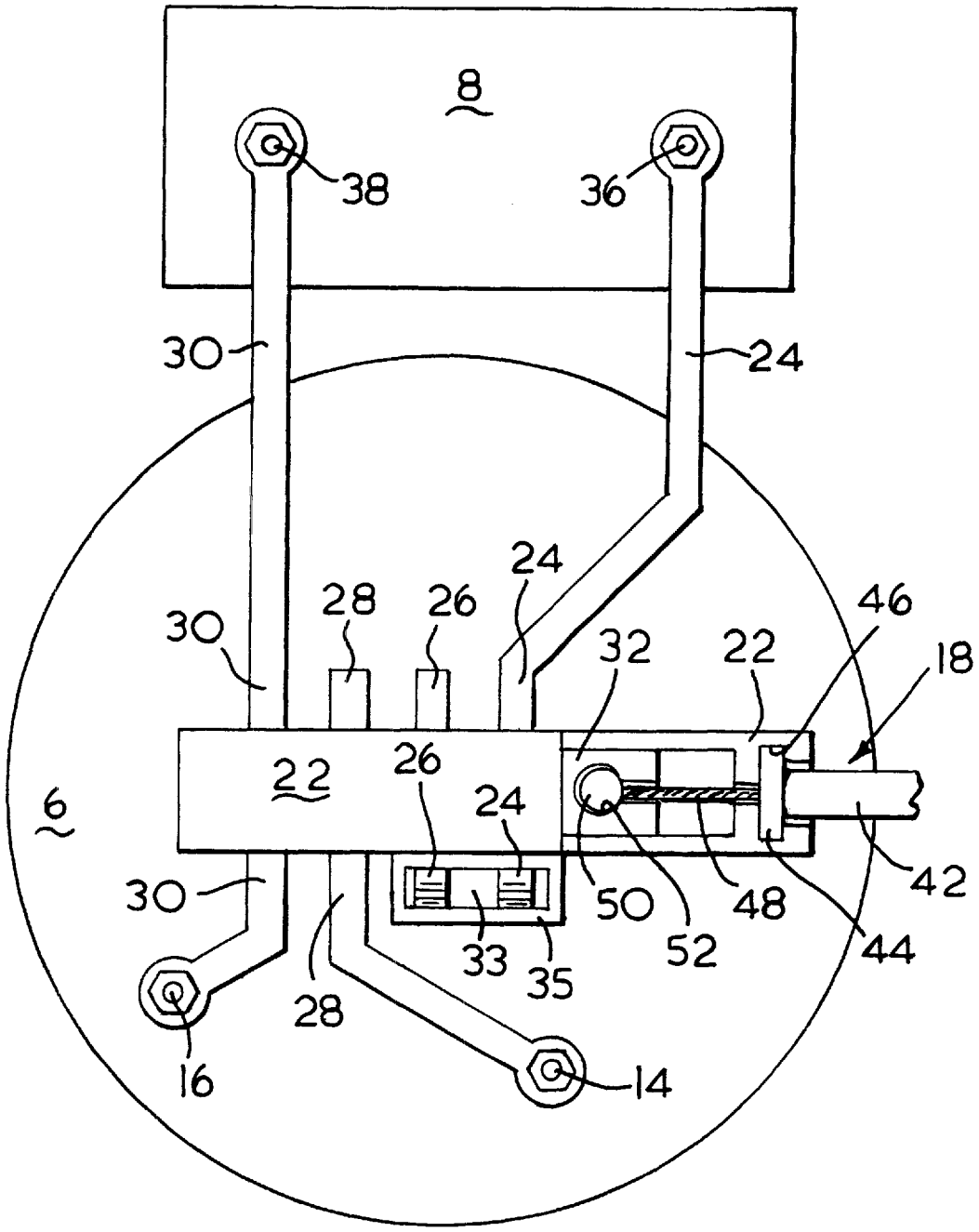
FIG. 2 shows a view of the first embodiment of switch from the top, mounted on top of the motor and connected to a battery without a fuse located in the socket.
Figure 3:
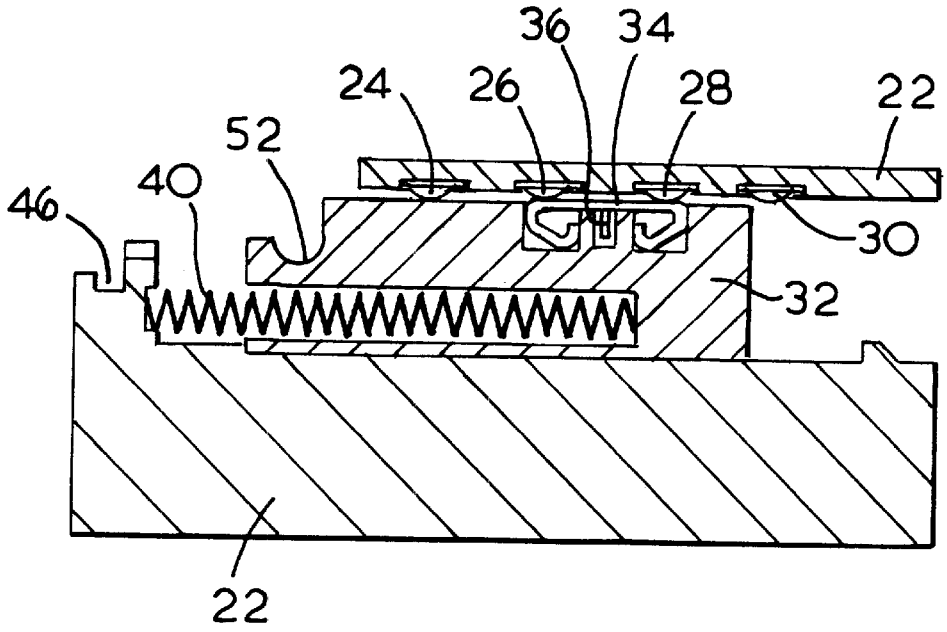
FIG. 3 shows a cross-sectional view of the first embodiment of switch with the bowden cable omitted along the longitudinal axis of the switch when the switch is in the "ON" position.
Figure 4:
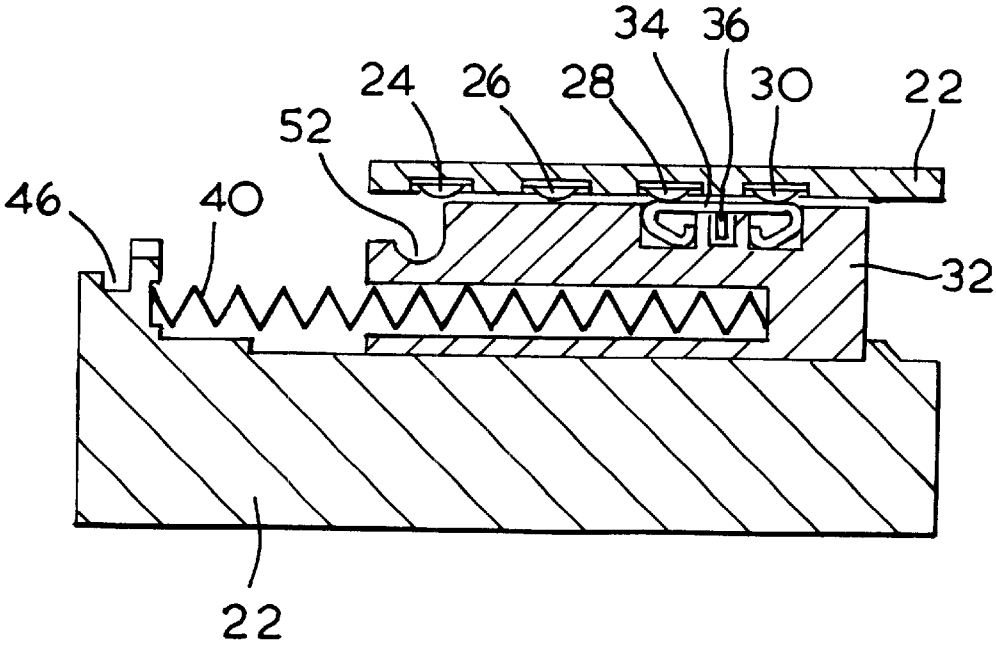
FIG. 4 shows a cross-sectional view of the first embodiment of switch with the bowden cable omitted along the longitudinal axis of the switch when the switch is in the "OFF" position.

The first embodiment of design of the electrical switch 12 comprises an insulating body 22 having four metal strips 24,26,28,30 which a re arranged side by side so that the y are in the same plane as and parallel to each other. The distance between adjacent metal strips 24,26,28,30 is equal, as most clearly shown in FIG. 2. A non conducting sliding element 32 as most clearly shown in FIGS. 3 and 4 is arranged to slide between two positions over the strips 24,26,28,30, with the direction of movement being perpendicular to the longitudinal axis of the metal strips 24,26,28,30 but parallel to the plane of the metal strips 24,26,28,30. The sliding element 32 comprises a metal tab 34 which covers part of an upper surface of sliding element 32 the upper surface sliding over and making contact with the metal strips 24,26,28,30. The metal tab 34 "floats" on a spring 36 which biases the metal tab 34 upwardly towards the strips 24,26,28.30. Therefore, as the sliding element 32 slides over the metal strips 24,26,28,30 when the sliding element 32 is in certain positions, the metal tab 34 will be in contact with two adjacent metal strips 24,26,28,30 enabling an electric current to pass between the two. By constructing the switch in this manner, the strips 24, 26, 28, 30 form both the internal connectors of the switch 12 connecting with the tab 34 and the terminals of the switch 12.

Figure 5:
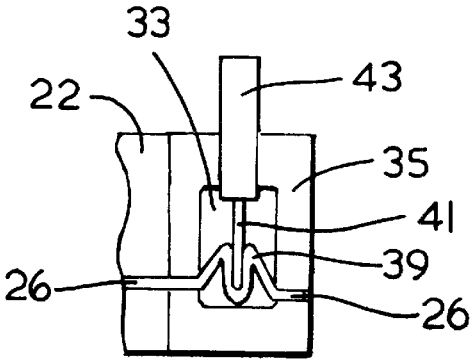
FIG. 5 shows a vertical cross-section of the socket through a terminal with a fuse located within the socket excluding the rest of the switch for both embodiments of switch.

The insulating body 22 of the switch also forms a socket 33 for a fuse 37. The walls 35 of the socket are integrally molded with the insulating body 22. The first 24 and the second 26 metal strips pass through the socket 33 as best shown in FIGS. 2 and 5. The metal strips 24, 26 are bent to form to V-shaped notches 39 which each receive a terminal 41 of the fuse 37. The fuse 37 is of a standard design comprising a body 43 and two terminals only one shown 41 linked by fuse wire not shown located within the body 43 which melts when a current greater than a pre-determined value passes through it. A sufficient amount of the fuse projects from the socket to allow the fuse to be easily inserted or removed to either disable the mower or replace the fuse 37 when it has blown.

The first metal strip 24 is connected directly to the positive electrode 36 of the battery 8 by a nut and bolt as best shown in FIG. 2. The second metal strip 26 is connected to the first metal strip 24 via the fuse 37. The third metal strip 28 is connected to one terminal 14 of the electric motor 6 by a nut and bolt. The fourth metal strip 30 is connected to the other terminal 16 of the electric motor 6 by a nut and bolt and to the negative electrode 38 of the battery 8.

The sliding element 32 can slide between the two positions. In the first or "ON" position as shown in FIG. 3 the sliding element 32 is located so that the metal tab 34 is in contact with the second 26 and third 28 metal strips. In the second or "OFF" position as shown in FIG. 4 the sliding element 32 is located so that the metal tab 34 is in contact with the third 28 and fourth 30 metal strips.

The sliding element 32 is resiliently biased by a spring 40 towards the second position. The sliding element 32 is moved between the two positions and held against the biasing force of the spring 40 by the bowden cable 18. The bowden cable 18 is attached to the switch 12 as shown in FIG. 2. The sleeve 42 of the bowden cable 18 terminates with a flange 44 of greater diameter than the sleeve 42. The flange 44 is located within a slot 46 formed within the insulating body 22 of the switch 12 which holds the sleeve 42 rigid relative to the insulated body 22. The cable 48 within the sleeve 42 extends beyond the sleeve 42 and terminates in a spherical ball 50. The ball 50 locates within a corresponding chamber 52 formed within the sliding element 32. Relative movements of the cable 48 to the sleeve 42 of the bowden cable 18 moves the sliding element 32 within the insulating body 22 by a corresponding amount.

When the motor is switched off, the sliding element 32 is in the second position. In use, a user would move the sliding element 32 to the first position using the bowden cable 18, thus forming an electrical connection between the second 24 and third 26 metal strips.

Current flows from the battery through the first metal strip 24, through the fuse 37, through the second metal strip 26, through the metal tab 34, through the third metal strip 28, through the motor 6, through the fourth metal strip 30 and back to the battery 8. A user would switch off the mower by moving the sliding element 32 from the first position to the second position using the bowden cable 18, first breaking the electrical connection between the second 26 and third 28 metal strips. This breaks current circuit and hence stops a current from being supplied to the motor 6. When the sliding element 32 returns to the second position, the metal tab 34 connects the third 28 and fourth 30 metal strips together, forming electrical contact between the two strips 28,30 and thus the two terminals 14,16 of the motor 6. The motor 6 continues to rotate for a period of time after the electric current has been removed until it runs to a stop. The electrical connection of the two terminals 14,16 of the motor 6 enables current generated by the rotating motor 6 to flow between the two and enables regenerative braking to occur within the motor 6, thus stopping it more quickly.

The metal strips 24,28,30 are connected directly to the terminals of the motor 6 and battery 8, thus avoiding the use of cables between switch 12 and motor 6 and battery 8. Thus the metal strips 24,26,28,30 form the internal connectors and the terminals of the switch which connect directly to the terminals of the motor and battery 8. The metal strips 24, 26, 28, 30 secure the switch 12 in position. The amounts of energy lost through the interconnections between the battery 8 and the motor 6 is dependent on the length and resistance of the interconnections. Therefore, by having the switch 12 mounted directly on top of the motor 6 the distance between the battery 8 via the switch 12 to the motor 6 is minimized thus reducing the energy lost through the interconnecting conductors. In addition, metal strips make ideal conductors for the large currents present in a battery powered mower. Furthermore, as the metal strips 24, 26, 28, 30 are connected directly to the terminals 14,16 of the motor 6, the number of connections within the electrical circuit is reduced thus minimizing the number of resistive barriers formed by such connections. Therefore, the amount of energy lost through the interconnections are reduced. This is an important feature of this battery powered lawn mower as it increases the run time of the mower between recharges.

By using the switch 12 as described in the first embodiment of the present invention, the resistance of the electric circuit formed whilst the motor is running can be reduced by as much as 50%.

In the second embodiment of design of the switch can be integrally formed with the motor, the insulating body 22 being formed as part of the motor casing and the bushes, which provide contact with the commutator of the motor, can be integrally formed with the metal strips 28,30 which connect with the motor 6.

In a third embodiment an electrical socket not shown can be formed in the side of the switch. The electrical connectors within the socket connect directly to the metal strips. Electrical devices mounted on the mower can be plugged in an electrical socket in order to obtain an electrical power supply directly from the main electrical circuit between the motor and the battery.

Figure 6:
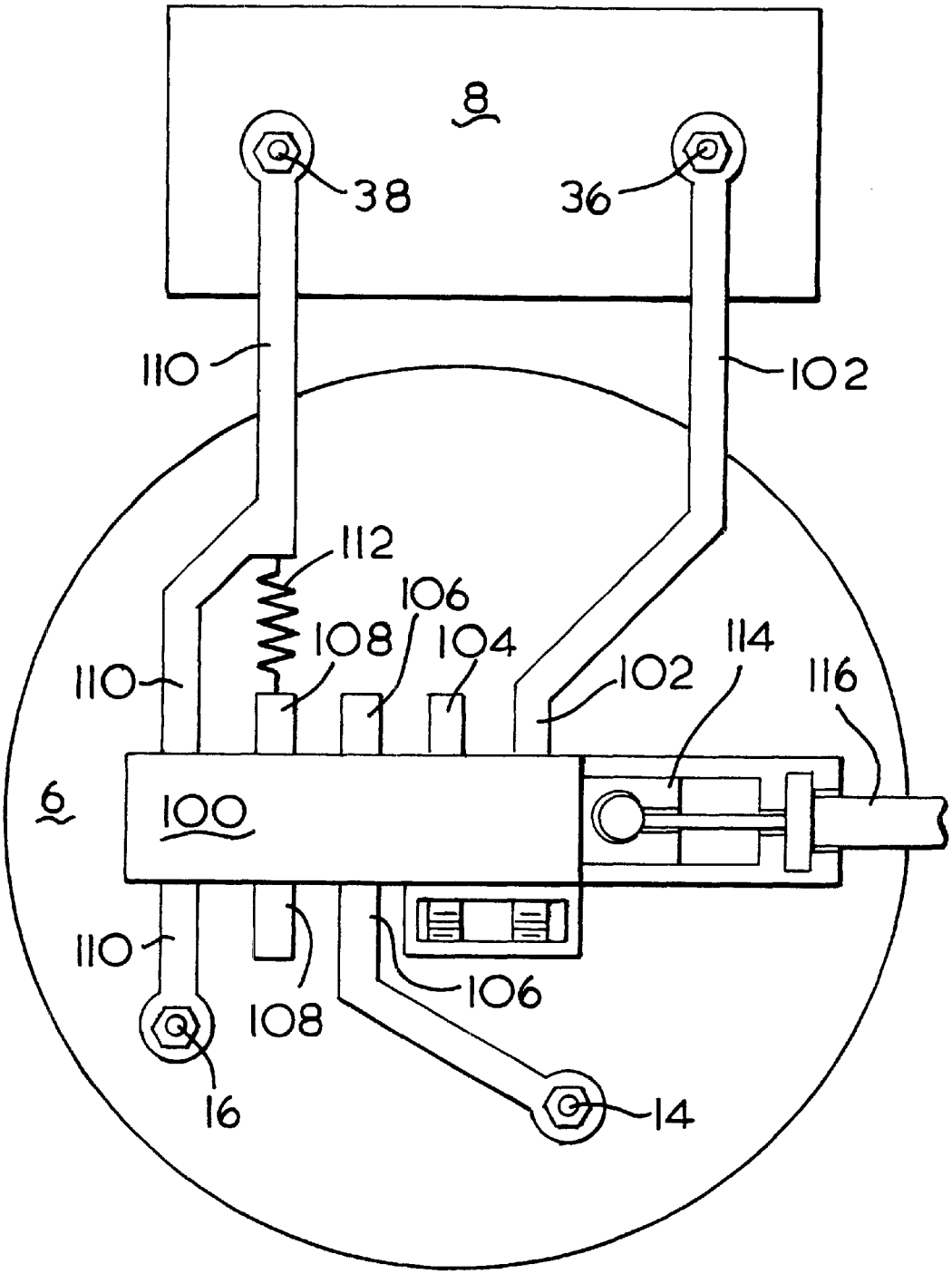
FIG. 6 shows a view of the fourth embodiment of the switch from the top, mounted on top of the motor and connected to a battery without a fuse located in the socket.

The fourth embodiment of the switch 100 according to the present invention is shown in FIG. 6. The switch 100 operates in the same way as the switch 12 described in the first embodiment. However, the switch 100 in the second embodiment has five metal strips 102, 104, 106, 108, 110 which form both the internal connectors of the switch 100 and the terminals of the switch 100.

The first metal strip 102 is connected directly to the positive electrode 36 of the battery 8 by a nut and bolt as best shown in FIG. 6. The second metal strip 104 is connected to the first metal strip 102 via a fuse not shown. The third metal strip 106 is connected to one terminal 14 of the electrical motor 6 by a nut and bolt. The fourth metal strip 108 is connected to the fifth metal strip 110 via a resistor 112 shown schematically. The fifth metal strip 10 is connected to the other terminal 16 of the electric motor 6 by a nut and bolt and to the negative electrode 38 of the battery 8.

The sliding element 114 can slide between the two positions. In the first or "ON" position the sliding element 114 is located so that a metal tab not shown in side the switch is in contact with the second 104 and third 106 metal strips. In the second or "OFF" position the sliding element 114 is located so that the metal tab is in connect with the third 106 and fourth 108 metal strips.

The sliding element 32 is resiliently biased by a spring not shown towards the second position and moved by a bowden cable 116.

When the motor is switched off, the sliding element 114 is in the second position. In use, a user would move the sliding element 114 to the first position using the bowden cable 116, thus forming an electrical connection between the second 104 and third 106 metal strips.

Current flows from the battery 8 through the first metal strip 102, through the fuse, through the second metal strip 104, through the metal tab, through the third metal strip 106, through the motor 6, through the fifth metal strip 110 and back to the battery 8. A user would switch off the mower by moving the sliding element 114 from the first position to the second position using the bowden cable 116, first breaking the electrical connection between the second 104 and third 106 metal strips. This breaks current circuit and hence stops a current from being supplied to the motor 6. When the sliding element 114 returns to the second position, the metal tab connects to the third 106 and fourth 108 metal strips together, forming electrical contact between the two strips 106, 108 and thus between the two terminals 14, 16 of the motor 6 via the fifth strip 110 and the resistor 112. The motor continues to rotate for a period of time after the electric current has been removed until it runs to a stop. The electrical connection of the two terminals 14, 16 of the motor 6 enables current generated by the rotating motor 6 to flow between the two and enables regenerative braking to occur within the motor 6, thus stopping it more quickly. The resistor 112 dissipates energy as the current generated by the rotating motor 6 passes through it.

What is claimed is:

1. A battery powered lawn mower comprising:

a cutting deck;

an electric motor mounted on the deck and having two terminals;

a battery mounted on the deck and in electrical connection with the motor;

a switch mounted on the deck which forms part of the electrical connection between the battery and the motor, the switch comprising terminals, wherein, at least two of the said terminals each define an uninterrupted, connection free conductive path from said switch to said motor terminals.

2. A battery powered lawn mower as recited in claim 1, wherein said switch comprises internal connectors which extend from within said switch to form said terminals of said switch.

3. A battery powered lawn mower as recited in claim 1, wherein, said at least two terminals of said switch which define the conductive path to the terminals of said motor are permanently attached to the terminals of said motor.

4. A battery power lawn mower as recited in claim 1, wherein said switch is located adjacent said terminals of the motor.

5. A battery powered lawn mower as recited in claim 1, wherein at least two of said terminals each define an uninterrupted, connection free conductive path to terminals of said battery.

6. A battery powered lawn mower as recited in claim 1, wherein, said terminals secure said switch in position.

7. A battery powered lawn mower as recited in claim 1, further comprising an over current protection device which forms part of the electrical connection between the battery and the motor, said over current protection device including terminals forming the electrical link between two of said terminals of said switch.

8. A battery powered lawn mower as recited in claim 7, wherein, said over current protection device is integrally formed with said switch.

9. A battery powered lawn mower as recited in claim 7, wherein, said switch comprises a socket for receiving said over current protection device.

10. A battery powered lawn mower as recited in claim 9, wherein, said socket is integrally molded into the body of said switch.

11. A battery powered lawn mower as recited in claim 10, wherein, said over current protection device is releasably attachable to said socket.

12. A battery powered lawn mower has recited in claim 1, wherein said motor has a housing and said switch has a body, the body of said switch integrally formed with the motor housing.

13. A battery powered lawn mower as recited in claim 1, wherein said switch is operated by a mechanical link.

14. A battery powered lawn mower as recited in claim 13, wherein said switch is operated by a bowden cable.

15. A battery powered lawn mower as recited in claim 1, wherein said switch comprises a movable connector having a terminal which selectively links two of said switch terminals in electrical contact.

16. A battery powered lawn mower as recited in claim 15, wherein said connector has a body which is integrally formed with a body of the switch.

17. A battery powered lawn mower comprising:

a cutting deck;

an electric motor mounted on the deck and having two terminals;

a battery mounted on the deck and in electrical connection with the motor;

a switch mounted on the deck which forms part of the electrical connection between the battery and the motor, the switch comprising terminals; wherein:

at least two of the said terminals extend from the switch and are connected directly to said motor terminals; and said switch comprises a sliding element having an electrical connector mounted thereon, wherein said electrical connector is slidable over said switch terminals so as to electrically link different adjacent pairs of said switch terminals depending on the relative position between the sliding element and said switch terminals.

18. A battery powered lawn mower as recited in claim 17, wherein, said switch is capable of switching between two modes of operation, a first mode wherein the switch completes the electric circuit between said battery and said motor and a second mode wherein the electric circuit is broken and said two motor terminals are connected together to form a regenerative breaking circuit in the motor when the motor is rotating.

19. A battery powered lawn mower as recited in claim 18, wherein, the regenerative breaking circuit formed when the switch is in the second mode of operation comprises a resistor.

20. A battery powered lawn mower as recited in claim 19, wherein said switch comprises a first switch terminal which is electrically connected to said first motor terminal and said first battery terminal, a second switch terminal which is electrically connected to said fist switch terminal via a resistor, a third switch terminal which is electrically connected to the second motor terminal, and a fourth switch terminal which is electrically linked to the second battery terminal, wherein in the first mode of operation the switch electrically connects the third terminal to the fourth terminal and in the second mode of operation the switch electrically connects the second terminal to the third terminal.

21. A battery powered lawn mower as recited in claim 20, wherein said switch comprises a fifth terminal which is connected to the fourth terminal via the current over load device, said fourth terminal linked to the second battery terminal via said fifth terminal.

22. A battery powered lawn mower comprising:

a cutting deck;

an electric motor mounted on the deck and having two terminals;

a battery mounted on the deck and in electrical connection with the motor;

a switch mounted on the deck which forms part of the electrical connection between the battery and the motor, the switch comprising terminals; wherein:

at least two of the said terminals extend from the switch and are connected directly to said motor terminals; and said switch comprises a first terminal which is connected to both a first motor terminal and to a first battery terminal, a second terminal which is connected to a second motor terminal, and a third terminal which is electrically linked to a second battery terminal, wherein in a first mode of operation the switch electrically connects the second terminal to the third terminal and in the second mode of operation the switch electrically connects the first terminal to the second terminal.

23. A battery powered lawn mower as recited in claim 22, wherein, said third switch terminal is linked to said second battery terminal via a fourth switch terminal which is connected to said third switch terminal via a current over load device.

24. A lawn mower comprising:

a battery;

a motor;

a switch, said switch including a plurality of conducting strips;

said battery, said switch and said motor forming an electrical circuit with said strips extending between said switch and said battery to define an uninterrupted, connection free conductive path between said switch and said battery and extending between said switch and said motor to define an uninterrupted, connection free conductive path between said switch and said motor.

25. The lawn mower recited in claim 24, wherein said motor comprises a deck plate, said battery, said motor and said switch all mounted on said deck plate.

26. A lawn mower comprising:

a battery;

a motor;

a switch, said switch including a plurality of conducting strips;

said battery, said switch and said motor forming an electrical circuit with said strips extending between said switch and said battery and between said switch and said motor to link said switch in said circuit between said switch and said motor; wherein:

said plurality of strips comprises three strips, said switch further comprising:

a body, said three metal strips supported by said body; and a movable electrical connector carried by said body; wherein:

a first of said strips is connected to a first battery terminal and a first motor terminal, a second of said strips is connected to a second motor terminal, and a third of said strips is electrically linked to a second battery terminal, said movable connector movable between a first position in which said connector electrically links said second strip and said third strip and a second position in which said connector electrically links said first strip and said second strip.

27. The lawn mower recited in claim 26, wherein said electrical connector is carried by a sliding element, said sliding element being mechanically linked to a remotely mounted pivotal lever which controls the position of said sliding element.

28. The lawn mower recited in claim 26, wherein said switch further comprises a fourth metal strip connected to the second battery terminal and electrically linked to said third metal strip by a fuse.

29. The lawn mower recited in claim 28, wherein said fuse is removably mounted on the switch body.

30. A lawn mower comprising:

a deck plate;

a battery;

a motor; and a switch; comprising:

a body;

a first terminal extending between said body and said battery to form a first uninterrupted, connection free conductive path;

a second terminal extending between said body and said motor to form a second uninterrupted, connection free conductive path; and a third terminal extending between said motor and said battery through said body to form a third uninterrupted, connection free conductive path.

* * * * *